US007473305B2

(12) United States Patent
Ahlborn

(10) Patent No.: US 7,473,305 B2
(45) Date of Patent: Jan. 6, 2009

(54) SELF-FLUSHING ELECTROSTATIC SEPARATOR

(75) Inventor: Stephan Ahlborn, Senden (DE)

(73) Assignee: Hengst GmbH & Co. KG, Muenster (DE)

( * ) Notice: Subject to any disclaimer, the term of this patent is extended or adjusted under 35 U.S.C. 154(b) by 153 days.

(21) Appl. No.: 10/575,901

(22) PCT Filed: Oct. 14, 2004

(86) PCT No.: PCT/DE2004/002283

§ 371 (c)(1),
(2), (4) Date: Apr. 14, 2006

(87) PCT Pub. No.: WO2005/039779

PCT Pub. Date: May 6, 2005

(65) Prior Publication Data

US 2007/0056443 A1 Mar. 15, 2007

(30) Foreign Application Priority Data

Oct. 16, 2003 (DE) ..... 203 15 935 U

(51) Int. Cl.
*B03C 3/011* (2006.01)
*B03C 3/36* (2006.01)

(52) U.S. Cl. ..... 96/61; 96/78; 96/97

(58) Field of Classification Search ..... 96/60–62, 96/44, 45, 47–50, 95, 97; 95/78; 55/DIG. 38
See application file for complete search history.

(56) References Cited

U.S. PATENT DOCUMENTS 1,309,221 A * 7/1919 Schmidt ..... 96/45
2,192,172 A * 3/1940 Anderson ..... 95/75
2,192,249 A * 3/1940 White ..... 95/75
3,478,494 A 11/1969 Lustenader et al.
3,492,790 A * 2/1970 Ebert ..... 96/39
4,352,681 A * 10/1982 Dietz ..... 96/61
4,588,423 A * 5/1986 Gillingham et al. ..... 96/43
4,597,780 A * 7/1986 Reif ..... 96/45
6,071,330 A * 6/2000 Matsubara et al. ..... 96/69
6,582,500 B1 6/2003 Ohadi et al.
6,635,105 B2 10/2003 Ahlborn et al.

FOREIGN PATENT DOCUMENTS

DE 19516817 6/1996

(Continued)

OTHER PUBLICATIONS

English Language Abstract of EP 0 685 635, dated Dec. 6, 1995.

(Continued)

*Primary Examiner*—Richard L Chiesa
(74) *Attorney, Agent, or Firm*—Greenblum & Bernstein, P.L.C.

(57) ABSTRACT

The invention relates to an electrostatic separator (1) for separating particles containing oil out of a gas stream, having an emission electrode (2) and a deposition electrode (3), wherein the emission electrode (2) has a front corona region (4) extending into the gas stream and a rear deposition region (5). An outlet opening (9) for separated oil running along the deposition electrode (3) is provided at the level of, or behind, the deposition region (5) of the emission electrode (2).

7 Claims, 2 Drawing Sheets

FOREIGN PATENT DOCUMENTS

| | | |
|---|---|---|
| DE | 19704461 | 5/1998 |
| EP | 0685635 | 12/1995 |
| FR | 1073149 | 9/1954 |
| GB | 2177625 | 1/1987 |
| WO | 02/04126 | 1/2002 |

OTHER PUBLICATIONS

English Language Abstract of DE 195 16 817, dated Jun. 27, 1996.
English Language Abstract of DE 197 04 461, dated May 7, 1998.

* cited by examiner

SELF-FLUSHING ELECTROSTATIC SEPARATOR

CROSS-REFERENCE TO RELATED APPLICATION

The present invention is a U.S. National Stage of International Application No. PCT/DE2004/002283 filed Oct. 14, 2004 and claims priority of German Patent Application No. 203 15 935.7 filed Oct. 16, 2003.

BACKGROUND OF THE INVENTION

1. Field of the Invention

The invention relates to an electrostatic separator for separating particles containing oil out of a gas stream. The electrostatic separator includes an emission electrode and a deposition electrode, and the emission electrode has a front corona region extending into the gas stream and a rear deposition region.

2. Discussion of Background Information

Such electrostatic separators are known from the automotive field for separating oil from the gas stream of a crankcase ventilator in internal combustion engines.

During operation of the electrostatic separator, deposits can occur on the deposition electrode, which impermissibly reduce the spacing between the deposition electrode and the emission electrode. Proposals are known for cleaning deposits on electrostatic separators through the use of moving parts.

SUMMARY OF THE INVENTION

The invention improves an electrostatic separator of the generic type to prevent the formation of deposits on the deposition electrode with the most economical and operationally reliable elements possible.

According to the invention, an electrostatic separator includes an outlet opening for separated oil positioned to run along the deposition electrode. This outlet opening is provided at the level of, or behind, the deposition region of the emission electrode.

The electrostatic separator according to the invention continuously flushes the deposition electrode, specifically with the oil that has been separated from the gas stream or is yet to be removed from the electrostatic separator. The emission electrode is oriented with its corona region opposing the flow direction of the gas stream.

Designated within the framework of the present proposal as the corona region and, respectively, the deposition region, are one region each of the electrostatic separator in the flow direction of the gas stream. Located in the corona region is the portion of the emission electrode forming the corona, which charges or ionizes the particles, and where only a small fraction of the particles are already accumulated on the deposition electrode. The majority of the charged particles are accumulated on the deposition electrode in the adjacent deposition region.

Provided on the deposition electrode in this deposition region, or even further downstream in the direction of the gas stream, is an outlet opening through which the oil deposited on the deposition electrode can be drained.

Due to the proposed embodiment of the electrostatic separator, moving parts, which under certain circumstances may be prone to vibration, can be dispensed with.

In an exemplary embodiment, an inventive electrostatic separator can be provided with an upward-pointing corona region, hence be arranged within a downwardly-directed gas stream. In this case, the outlet opening for the oil is located correspondingly far down. The drainage of the oil at the deposition electrode is supported on the one hand by gravity and on the other hand by the gas stream. A reversal of direction of the air stream above the emission electrode effects a centrifugal-force-induced preliminary separation from the gas stream of the larger particles, in particular, which in this way arrive at the wall of the flow redirection chamber, where they can flow down to the deposition electrode.

Especially advantageously, such a chamber can be embodied as a cyclone so that this chamber can serve as a true coarse separator or preseparator, and further separate coarse separators can be dispensed with. As a result, the installation of the electrostatic separator alone can be sufficient to allow an adequate cleaning of the gas stream, so that the use of an electrostatic separator embodied in such a manner makes possible considerable savings both with regard to the assembly as well as with regard to the installation space required, and finally also with regard to the quantity of material required, as compared to the use of an electrostatic separator which serves solely as a fine separator and works together with a separate coarse separator additionally connected upstream.

In another exemplary embodiment, the electrostatic separator is arranged for use with upward-flowing gas stream, such that the corona region of the emission electrode points downward in orientation. The gas stream must have a sufficiently high flow velocity for as large a quantity as possible of the oil deposited on the deposition electrode to be transported upward, where it can reach the outlet opening in order to return to the rest of the oil circulation through a separate outlet line. Here, too, a chamber for flow redirection of the gas stream is provided above the emission electrode, wherein the outlet opening for the separated oil is arranged between this chamber and the deposition electrode. In this chamber, a baffle can advantageously be provided, which causes the redirection of the gas stream, thus improving the degree of separation.

BRIEF DESCRIPTION OF THE DRAWINGS

Two exemplary embodiments of the invention are explained in detail below on the basis of the two purely diagrammatic drawings.

DETAILED DESCRIPTION OF THE INVENTION

Figure 1:
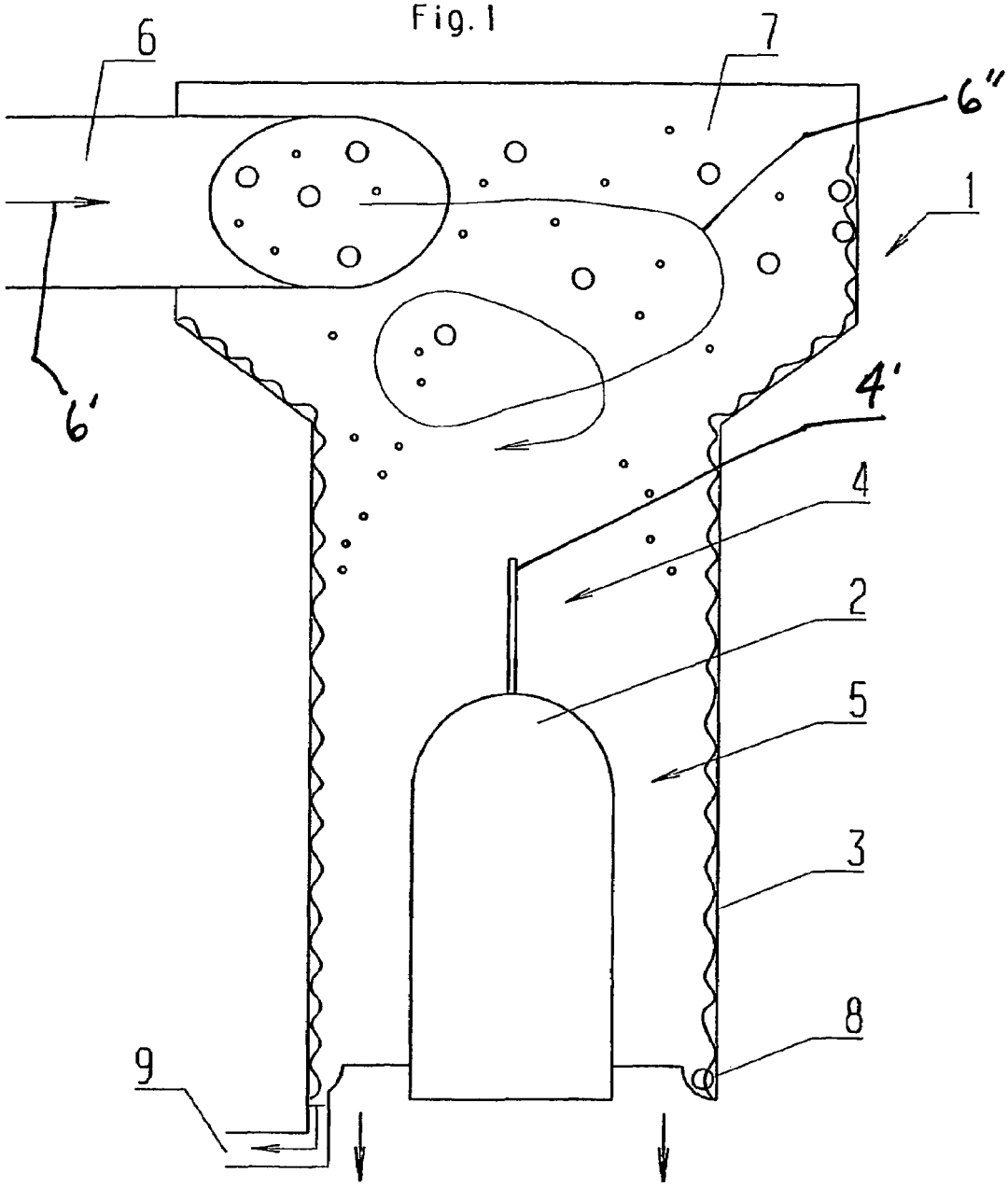
FIG. 1 illustrates an electrostatic separator in accordance with an embodiment of the invention in which the gas flows through the separator from top to bottom.

In FIG. 1, an electrostatic separator as a whole is diagrammatically labeled 1, and includes an emission electrode 2 and a deposition electrode 3. The emission electrode 2 has a corona region 4 formed around a needle-like element 4' extending from emission electrode 2, and also has a deposition region 5 with a diameter that is much larger in comparison to emission electrode 2.

The gas stream (arrow 6') is guided through the electrostatic separator 1 in that it first enters a chamber 7 through a gas inlet opening 6. The gas inlet opening 6 and the chamber 7 are designed and arranged such that a cyclone effect (see arrow 6") results, whereby the coarser oil particles, in particular, are separated already in this chamber 7 onto the chamber walls thereof.

From the chamber 7, the wall transitions into the deposition electrode 3, so that the oil which was separated within the chamber 7 runs along the deposition electrode 3, wets it, and in this way prevents the formation of deposits on the deposition electrode 3.

As the gas stream continues, it reaches the corona region 4, where the particles remaining in the gas stream are charged. In this way, the charged particles move to, and are deposited onto, the deposition electrode 3. According to the exemplary embodiment, the deposits may particularly collect on the deposition electrode 3 in the section of the electrostatic separator 1 where the deposition region 5 of the emission electrode is located.

The entire volume of separated oil arrives at a collecting trough 8 at the bottom of the deposition electrode 3, where an outlet opening 9 is arranged to feed the oil back into the oil circulation.

Figure 2:
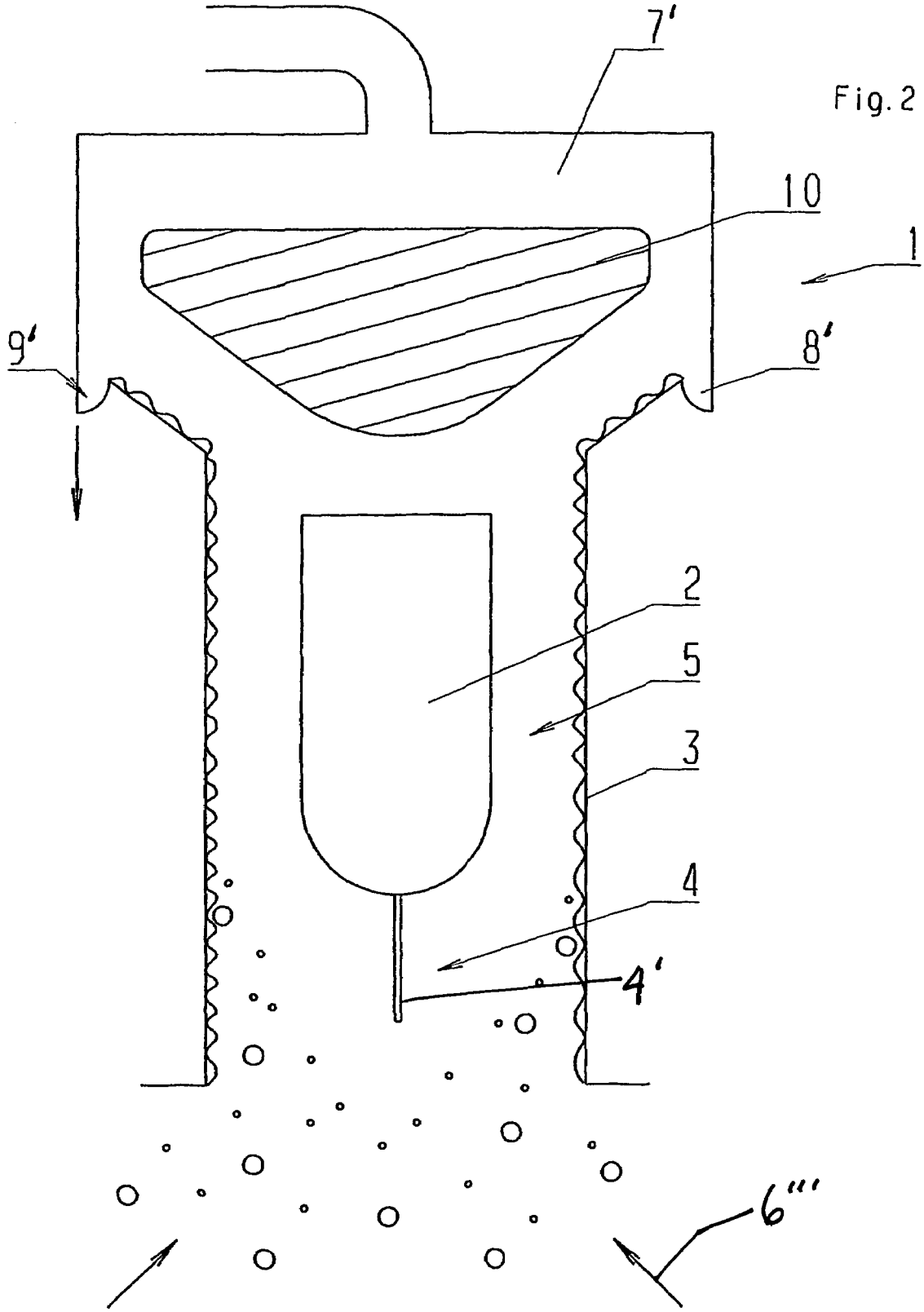
FIG. 2 illustrates an electrostatic separator in accordance with another embodiment of the invention in which the gas flows through the separator from bottom to top.

In FIG. 2, a second exemplary embodiment of the invention is shown in which essentially like components are labeled with the same reference numbers as in FIG. 1. In this second exemplary embodiment, however, the discharge electrode 2 is oriented downward, and thus has a downward-pointing corona region 4 formed around needle-like element 4'. Moreover, the flow through this electrostatic separator 1 accordingly takes place from bottom to top and the oil particles located at (collected on) the deposition electrode 3 are transported upward by the gas stream (arrows 6'''). However, the transporting of the oil particles is achieved without the particles being entrained and entering the gas stream, since they coagulate (collect) on the deposition electrode 3 and form correspondingly large particles or, respectively, an oil film on the deposition electrode 3.

Arranged in the chamber 7' for redirection of the gas stream, which is provided above the emission electrode 2 in this exemplary embodiment as well, is a baffle 10, which effects the change in direction and, despite being called a "baffle," is flow-optimized, since the gas stream is not directed against the baffle 10 for the separation of oil particles. Instead, the baffle 10 is intended to divert the gas stream and direct it against the walls of the chamber 7' so that an additional after purification of the gas stream takes place here if needed.

The oil ascending along and being separated on the deposition electrode 3 arrives at a collecting trough 8', which is provided between the chamber 7' and the deposition electrode 3. The oil is conveyed by this collecting trough 8' out of the electrostatic separator 1 through an outlet opening 9' and, for example, returned to the remaining oil circulation.

The invention claimed is:

1. An electrostatic separator for separating particles containing oil out of a gas stream of an internal combustion engine crankcase, comprising:

a chamber having a gas stream inlet and being structured and arranged to redirect the gas stream entering the chamber;

an emission electrode comprising a needle element extending upwardly along a longitudinal axis of the electrostatic separator and arranged to form, relative to a gas stream direction, a front corona region and a rear deposition region;

a deposition electrode surrounding the emission electrode and the rear deposition region;

a collecting trough located at a lower end of the rear deposition region;

an outlet opening structured to receive the separated particles from the collecting trough and arranged adjacent the deposition electrode and at a level with or after, relative to the gas flow direction, the rear deposition region;

the chamber located above the emission electrode and having a downwardly converging wall transitioning into the deposition electrode; and the gas stream inlet arranged at an upper end of the electrostatic separator, the outlet opening arranged at a lower end of the electrostatic separator, wherein the gas stream flows downwards from the chamber and between the emission electrode and the deposition electrode, and wherein the electrostatic separator is structured and arranged to separate the particles containing oil from the gas stream of the internal combustion engine crankcase.

2. The electrostatic separator in accordance with claim 1, wherein the chamber is structured and arranged to form a cyclone above the emission electrode to redirect the gas stream.

3. The electrostatic separator in accordance with claim 1, wherein separated particles collected on the chamber walls flow downward along the deposition electrode to the outlet opening.

4. The electrostatic separator in accordance with claim 1, wherein the chamber is structured to form a cyclone, which directs the portion of oil particles in the gas stream against the chamber wall.

5. An electrostatic separator for separating particles containing oil out of a gas stream of an internal combustion engine crankcase, comprising:

a gas stream inlet arranged at a lower end of the electrostatic separator;

a chamber having a redirecting element for redirecting a gas stream entering the chamber;

an emission electrode comprising a needle element extending downwardly along a longitudinal axis of the electrostatic separator and arranged to form, relative to a gas stream direction, a front corona region and a rear deposition region;

a deposition electrode surrounding the emission electrode and the rear deposition region; the chamber located above the emission electrode and having a downwardly converging wall at a lower end of the chamber transitioning into the deposition electrode;

a collecting trough located at the top end of the converging wall; and an outlet opening positioned adjacent the collecting trough and structured to receive the separated particles from the collecting trough and arranged at a level after, relative to the gas flow direction, the rear deposition region, wherein the gas stream flows upwards between the emission electrode and the deposition electrode and into the chamber, and wherein the electrostatic separator is structured and arranged to separate the particles containing oil from the gas stream of the internal combustion engine crankcase.

6. The electrostatic separator in accordance with claim 5, wherein the redirecting element is a baffle arranged within the chamber to redirect the gas stream outwardly.

7. The electrostatic separator in accordance with claim 5, wherein the redirecting element includes a baffle structured and arranged to direct the portion of oil particles in the gas stream against the chamber wall.

* * * * *